US006247501B1

(12) United States Patent
Kaines

(10) Patent No.: US 6,247,501 B1
(45) Date of Patent: Jun. 19, 2001

(54) CLIP-ON STIRRUP MAT

(76) Inventor: John L. Kaines, 101 S. James St., Suite 210, P.O. Box 603, Ludington, MI (US) 49431

( * ) Notice: Subject to any disclaimer, the term of this patent is extended or adjusted under 35 U.S.C. 154(b) by 0 days.

(21) Appl. No.: 09/675,238

(22) Filed: Sep. 29, 2000

(51) Int. Cl.[7] ..... F16L 55/00

(52) U.S. Cl. ..... 138/175; 138/172; 245/2; 245/3; 140/107

(58) Field of Search ..... 138/175, 176, 138/172, 174; 52/661, 664, 662, 676, 665; 245/2, 3, 11; 140/92.1, 107; 264/228

(56) References Cited

U.S. PATENT DOCUMENTS

| | | | |
|---|---|---|---|
| 3,411,545 | 11/1968 | Keyser | 138/175 |
| 3,419,047 | 12/1968 | Osweiler | 138/175 |
| 3,440,792 | 4/1969 | Schmidgall | 52/684 |
| 3,826,287 | 7/1974 | Tolliver | 138/175 |
| 3,857,416 | 12/1974 | Boroding et al. | 138/175 |
| 4,067,521 | 1/1978 | Byard | 245/3 X |
| 4,184,520 | 1/1980 | Tolliver | 140/107 |
| 4,295,497 | 10/1981 | Tolliver | 138/175 X |
| 4,295,501 | 10/1981 | Tolliver | 138/175 X |
| 4,345,626 | 8/1982 | Tolliver | 138/175 X |
| 4,439,972 | 4/1984 | Tolliver | 138/175 X |
| 4,441,527 | 4/1984 | Tolliver | 138/175 |
| 4,466,467 | 8/1984 | Tolliver | 138/175 |
| 4,467,995 | 8/1984 | Tolliver | 138/175 X |
| 4,494,576 | 1/1985 | Buttner | 138/175 |
| 4,999,965 | 3/1991 | Schmidgall et al. | 52/687 |
| 5,410,850 | 5/1995 | Dreizler | 52/309.17 |
| 5,924,458 | 7/1999 | Kaines | 138/175 |

*Primary Examiner*—Patrick Brinson
(74) *Attorney, Agent, or Firm*—John A. Waters; Waters & Morse, P.C.

(57) ABSTRACT

A clip-on stirrup mat for a concrete reinforcement cage comprises at least one and preferably a plurality of resilient clips attached to the stirrup mat and extending outwardly therefrom in the direction of application of a mat to a cage. The clip has a relatively narrow outer end that fits between adjacent wires in the cage and has inwardly extending, diverging first and second legs that lead to more widely spaced distal ends that form an inner end of the clip. The first leg is attached to the mat adjacent a distal end of the leg, and the second leg is resiliently deflectable toward the first leg. The clip and legs are shaped and positioned on the mat such that, as the mat is attached to the cage, the outer end of the clip fits through adjacent wires in the cage and the second leg engages and is deflected toward the first leg by one of the adjacent cage wires. The second leg includes a gripping surface thereon, which may be convolutions, that engages a wire on the cage as the mat is installed on the cage. The gripping surface resists the removal of the clip and mat from the wire cage once the mat has been installed. Clips are preferably mounted at regular intervals on stirrup mat element wires and are spaced so that the clips fit on single and double wrapped cages.

11 Claims, 5 Drawing Sheets

CLIP-ON STIRRUP MAT

BACKGROUND OF THE INVENTION

Stirrup mats are used in connection with reinforced concrete products in order to provide added shear stress reinforcement for the concrete. A stirrup mat typically comprises a mat formed of a wire grid having a series of reinforcement prongs (or loops) attached to the wires so as to extend at right angles to the plane of the mat. Stirrup mats usually are attached manually by wire ties to one of two concentric wire grid reinforcement cages used for the reinforced concrete. The mat may be attached to the inner or outer side of either of two spaced wire cages, with the prongs of the mat extending between the cages. Attachment of a stirrup mat to a reinforcement cage by means of wire ties is a time consuming process that often involves two people. One person is required to hold the mat in place against the cage, while another person manually ties the stirrup mat to the cage with wire ties. While a single person usually can tie a four foot stirrup mat to a cage, two people usually are necessary for a stirrup mat that is six to eight feet long.

In order to overcome the drawbacks with manually attachable stirrup mats, some self-locking stirrup mats have been developed, wherein the mats are clipped to the cages by clips integrally attached to the mats. Applicant's U.S. Pat. No. 5,924,458, which is incorporated by reference, discloses a self-locking stirrup mat including integral clips.

An object of the present invention is to provide an improved clip-on stirrup mat that can be attached to both single and double wrapped cages (wherein an inner or outer cage includes a double layer of wire grid reinforcement).

DETAILED DESCRIPTION OF PREFERRED EMBODIMENT

Figure 1:
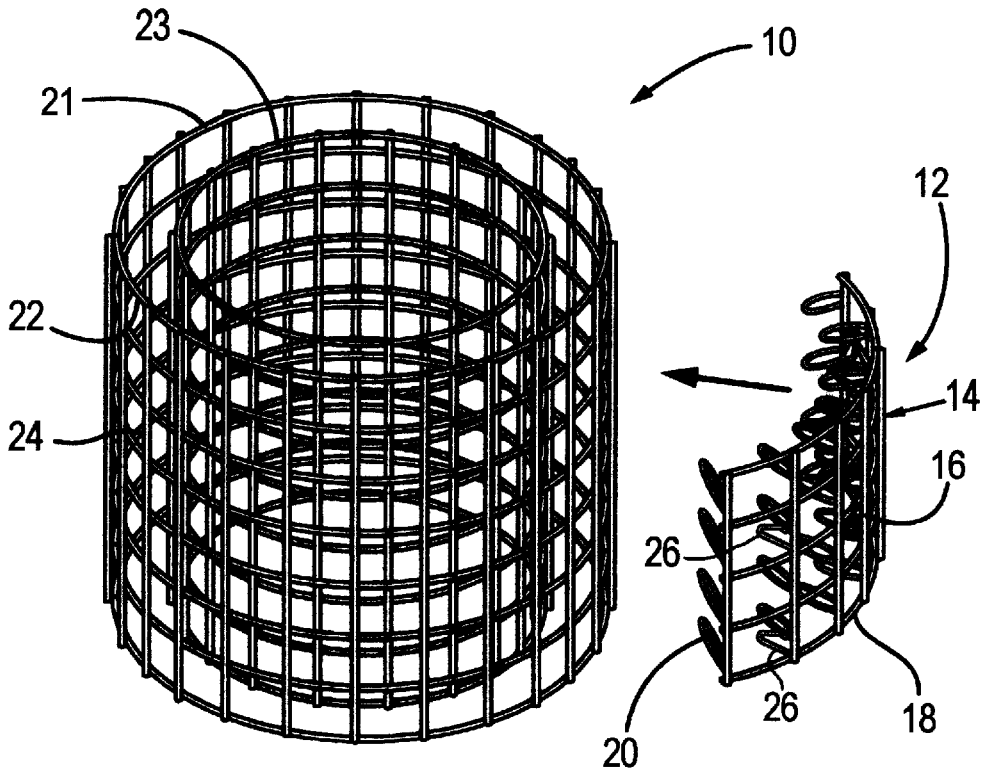
FIG. 1 is perspective view of a double cage pipe reinforcement employing the stirrup mat of the present invention.

Referring to the drawings, a wire reinforcement cage construction 10 for concrete pipe, shown in FIG. 1, employs a self-locking clip-on stirrup mat 12. Stirrup mat 12 comprises a wire grid 14 formed of longitudinal wires 16, called element wires, and transverse wires 18, called tie wires. Desirably, the tie wires are manually formable for ease in installation, as shown in U.S. Pat. No. 4,184,520, which is incorporated here-in by reference. Wire loops or prongs 20, called stirrup elements, are fastened, usually by spot welding, to the element wires 16 of grid 14 so as to protrude at right angles from the grid.

Figure 2:
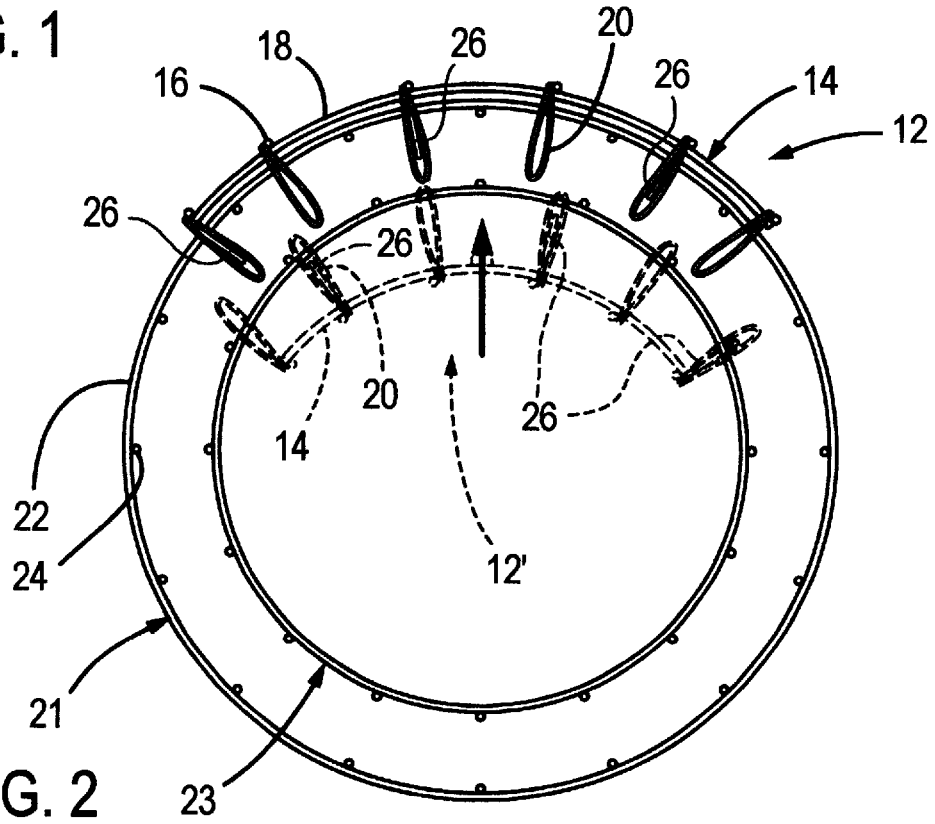
FIG. 2 is a schematic end view of a reinforcing cage for concrete pipe employing a clip-on stirrup mat in accordance with the present invention.

Stirrup mat 12 may be inserted in an outer wire reinforcement cage 21 as in the manner shown in FIG. 1, wherein the mat is positioned on the outside of the cage and stirrup elements extend through the wires of the cage, which comprise circumferential wires 22 and longitudinal wires 24. The circumferential wires can be circular or helical. Alternatively, the stirrup mat 12 may be inserted outwardly from the inner side of a cage 23, as shown in phantom in FIG. 2. This is the most common practice. The invention can be employed with various types and shapes of reinforcement cages or panels, which are referred to as cages herein.

Stirrup mat 12 is held on the wire cage by an attachment mechanism comprising a plurality of spring clips 26 mounted at spaced intervals on the wire grid. The spring clips become wedged between adjacent circumferential wires of the cage when the stirrup mat is pressed into position against the wire cage, locking the stirrup mat in place.

Figure 4:
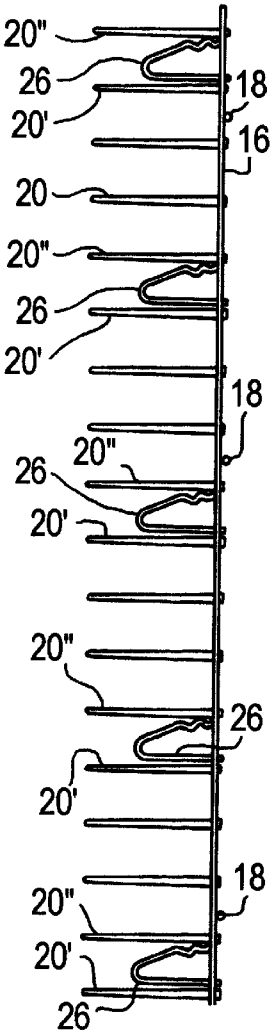
FIG. 4 is an edge view of the stirrup mat of FIG. 3.
Figure 3:
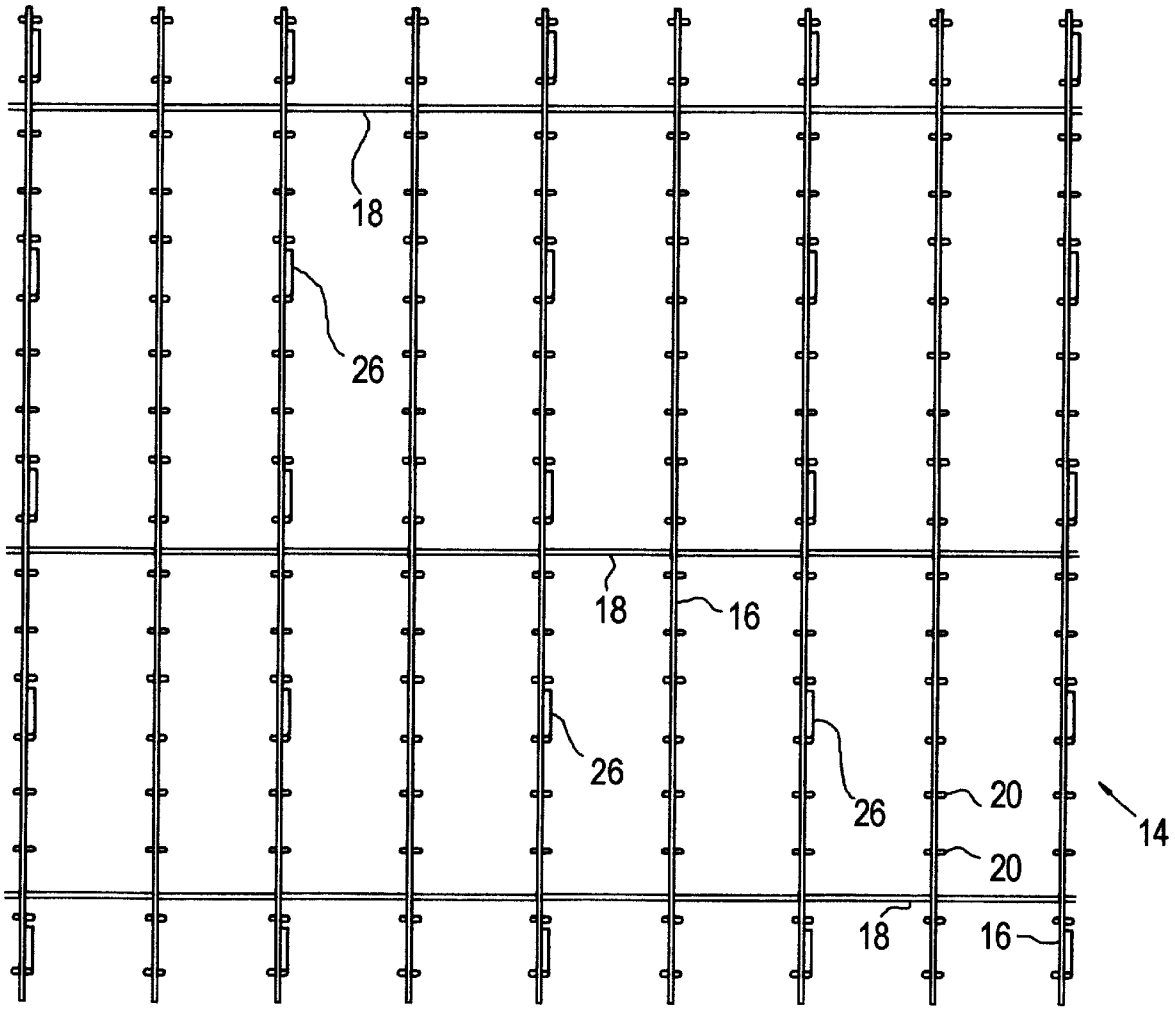
FIG. 3 is a plan view of the stirrup mat of the present invention.

The construction of stirrup mat 12 is shown in FIGS. 3 and 4. Stirrup mats 12 typically are 3, 4, or 5 feet wide and 3 to 8 feet long and consist of a plurality of longitudinal element wires 16 spaced approximately two to six inches apart by flexible tie wires 18 that interconnect the element wires. In a typical stirrup mat about four feet long, three tie wires may be employed. Stirrup elements are spot-welded to the element wires and extend perpendicularly from the plane of the stirrup mat. The spacing of stirrup elements generally corresponds with the spacing of the wires in the cage to which the mat is to be applied. A cage wire spacing of two inches (with a tolerance of one quarter inch) is most common. In such a case, stirrup elements are fastened every two inches along an element wire, so each stirrup element can be positioned against a cage wire. The construction of the stirrup mat itself is conventional.

Figure 9:
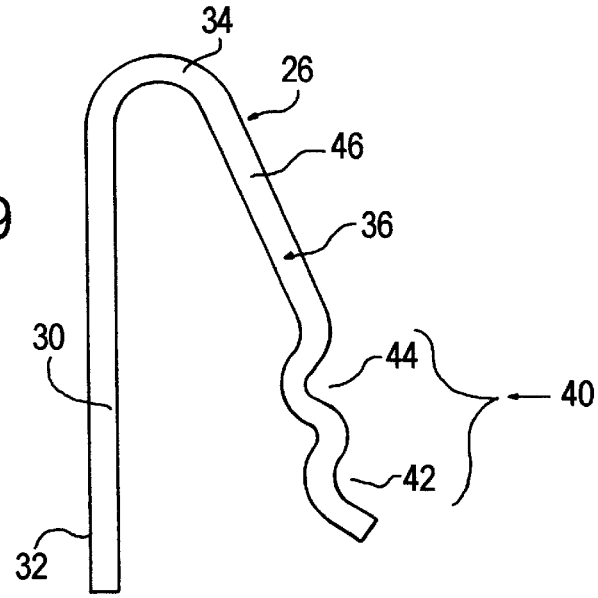
FIG. 9 is a plan view of a spring clip employed in the stirrup mat of the present invention.
Figure 7A:
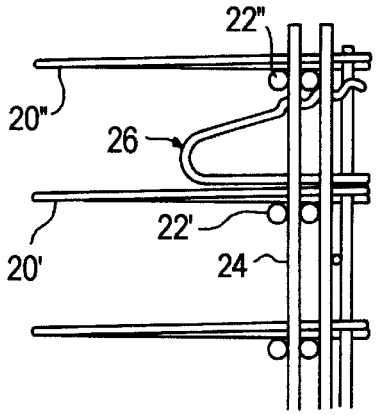
FIG. 7*a* is a fragmentary edge view showing the stirrup mat of the present invention connected to a double layer wire cage ("double cage") wherein the circumferential wires are positioned outside the longitudinal wires and the circumferential wires for both cage layers are generally aligned.
Figure 7B:
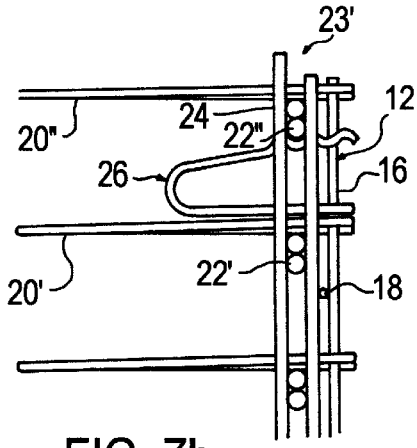
FIG. 7*b* is a view similar to FIG. 7*a* wherein the circumferential wires are not aligned.

Stirrup mat 12 is mounted on cage 10 by means of a plurality of individual spring clips 26 shown mounted on the stirrup mat in FIG. 4 and shown separately in FIG. 9. The clips are mounted between stirrup elements on element wires, typically at a spacing of 12 to 18 inches. The clips are mounted on every other element wire in the illustrated embodiment. Clips 26 can be formed of conventional steel wire, preferably 8 gage steel, which is about 0.162 inches in diameter. A preferred wire diameter range is 0.120 inches (11 gage) to 0.225 inches (4 gage) in diameter. Conventional cold-rolled steel can be employed. The diameter of the clips is selected so the cross sectional area of the clip wire is not substantially greater than the total cross sectional area of the stirrup element. The clip compresses when it is installed and it is desired that the compression force be substantial while not being so great that the clip causes the stirrup element to bend.

Clip 26 comprises a wire loop having first and second legs 30 and 36, with an arcuate looped end 34 forming a bright portion positioned between the legs. Legs 30 and 36 are positioned at an inclined angle with respect to each other. This angle is selected so the second leg deflects substantially when the mat is installed but does not have to deflect so much that installation is difficult. An angle range of 15–30 degrees is preferred. An angle of about 22 degrees is desirable. Leg 30 is attached to stirrup mat element wires at a distal lower end 32 (by spot welding or the like) adjacent a stirrup element. Leg 30 extends perpendicularly to the plane of the stirrup mat.

Leg 36 extends inwardly at an angle back toward the adjoining stirrup element. Leg 36 has a gripping surface formed by a convoluted distal end 40 having two or more indentations 42 and 44. These restrain the mat from being removed from the cage once it has been installed. An intermediate portion 46 is positioned at an inclined angle with respect to Leg 30 and acts as a cam surface in the manner described below.

Figure 5:
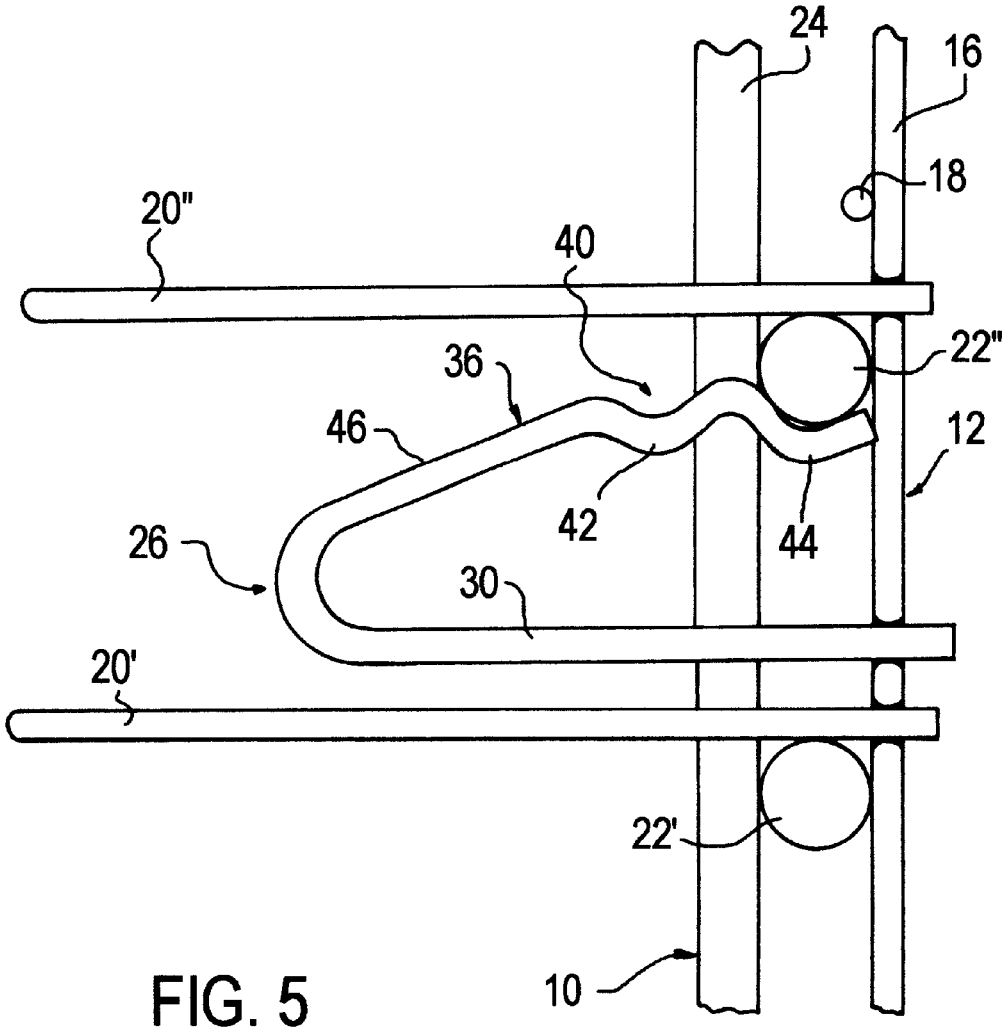
FIG. 5 is a fragmentary view showing a stirrup mat according to the present invention attached to a wire cage.

Referring to FIG. 5, stirrup mat 12 is mounted on cage 10 by inserting the loops 20' and 20" of the stirrup mat through the cage grid. As this is done, circumferential wire 22" first engages inclined surface 46 on leg 36. This causes the leg to deflect inwardly, and the leg in turn exerts an outward resilient force against circumferential wire 22". This outward force urges stirrup element 20' into an abutting relationship with circumferential wire 22', which is the desired position for mounting stirrup elements. When the clip is fully inserted into the cage, one of the indentations on the end of leg 36 engages and holds the circumferential wire 22" in place. After a stirrup mat has been mounted on a cage, it is quite difficult to remove the cage simply by pulling on the cage. An outward force on the stirrup mat causes leg 36 to bind against the circumferential wire of the cage. The clip can become permanently bent and lodged on the cage securely. This is desirable because substantial forces are sometimes exerted against a stirrup mat and it is important that the stirrup mat be securely held in place.

The dimensions and position of clip 26 are selected so that the clip is partially compressed between adjacent circumferential wires of the cage, thus causing leg 36 to urge the adjacent stirrup element or prong 20' against the adjacent circumferential wire 22' of the cage. In a typical installation, the clips are mounted approximately twelve to eighteen inches apart on the element wires, with leg 30 of each clip being close to a stirrup element 20' (usually about 0.25 inch away). In a mat employing a two inch spacing for the stirrup elements (which is used with a cage with a two inch wire opening), the clip itself is approximately one and three quarters inches wide at the ends of the legs. The legs of the clips are generally about two to three and one-quarter inches long. The clip length is selected so that the clip length is no greater than the stirrup element length, which can be two to fourteen inches long. The clip is desirably positioned, in relation to the adjacent stirrup element 20', so that the outer end of inclined leg 36 almost touches the next stirrup element 20" prior to compression. The distance between element 20' and the distal end of leg 36 is greater than the spacing between the cage wires, so the clip leg 36 is deflected toward leg 30 when the mat is installed on the cage.

The shape and position of the clip is significant. When the mat and clip are installed on a cage, leg 36 deflects sufficiently that the cage wire 22" tends to bend the clip rather than slip off the clip when the mat is pulled away from the cage.

Figure 6A:
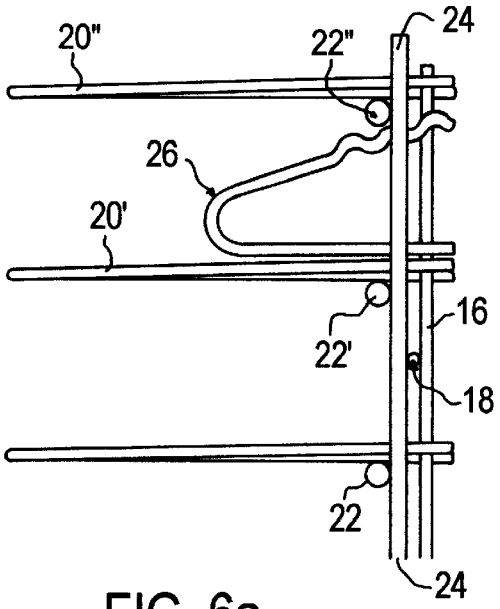
FIG. 6*a* is a fragmentary edge view showing a stirrup mat according to the present invention attached to a wire cage wherein the circumferential wires are mounted on the outside of the longitudinal wires of the cage.
Figure 6B:
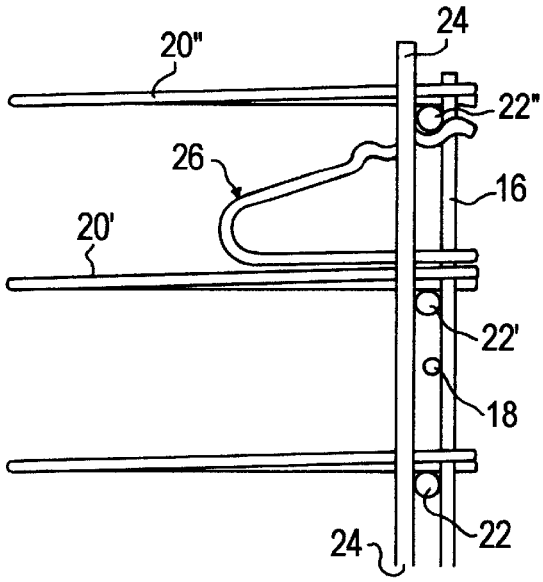
FIG. 6*b* is a fragmentary edge view showing a stirrup mat according to the present invention attached to a wire cage wherein the circumferential wires are mounted on the inside of the longitudinal wires of the cage.

One of the important advantages of the clip mechanism of the present invention is its versatility. For example, it does not matter whether the circumferential wires are positioned on the inside or outside of the longitudinal wires. Thus, in FIG. 6*a*, circumferential wires 22 are positioned on the opposite side of longitudinal wires 24 from grid wires 16 and 18 of the stirrup mat, whereas in FIG. 6*b*, circumferential wires 22 are positioned on the same side of longitudinal wire 24 as stirrup mat grid wires 16 and 18. In either case, clip 26 wedges securely between adjacent circumferential wires and holds the stirrup mat securely in place.

Figure 8A:
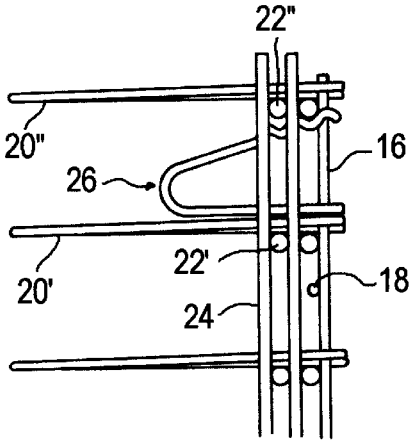
FIG. 8*a* is a fragmentary edge view of a double cage employing the stirrup mat of the present invention, wherein the circumferential wires are positioned inside the longitudinal wires of the cage.
Figure 8B:
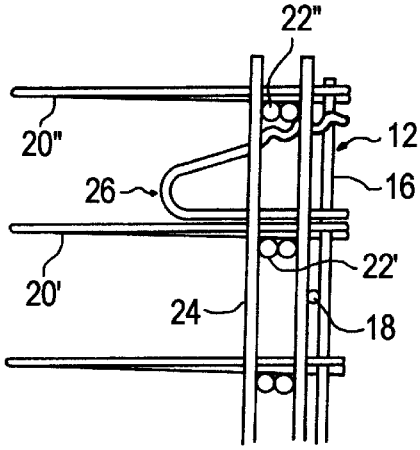
FIG. 8*b* is a view similar to FIG. 8*a* wherein the circumferential wires are in abutment.

Referring to FIGS. 7*a*, 7*b*, 8*a*, and 8*b*, it can be seen that the stirrup mat can also be clipped securely in a double layer wire cage, and the relative alignment of the circumferential wires in the adjacent cage layers can vary widely, while still permitting a secure attachment of the stirrup mat. For example, in FIG. 7*a*, the circumferential wires of the cage are positioned on the outside of the cage, and are generally in alignment. On the other hand, in FIG. 7*b*, the circumferential wires are spaced out of radial alignment. This causes the clip to be more compressed than in FIG. 7*a*, but the clip, nonetheless, holds the stirrup mat securely in place on the reinforcement cage. Alternative positions of the circumferential wires are shown in FIGS. 8*a* and 8*b*, with the same result, namely, that the clip still holds the stirrup mat securely in place on the cage structure.

In addition to the secure attachment of the stirrup mat to the wire cage, the present invention has other advantages. One advantage, as indicated above, is that the clips tend to deform plastically as they are wedged into place, thus preventing the clips from resiliently releasing when the stirrup mat is urged in a direction away from the wire cage.

The labor savings achieved in installation is a major advantage to the present invention. With a non-self-locking stirrup mat, it might take two hours to attach eight—four foot mats to a double wrapped cage for a ten foot diameter pipe section. With the mat of the present invention, eight mats can be attached in less than thirty minutes. Further, the normal fastening process requires 24 wire ties. The new mat still requires some tie wires to secure the mat but generally no more than six wire ties per mat are required.

When larger mats are employed, further labor savings is achieved. Larger mats, in the range of six to eight feet, require one person to hold the mat in place and another person to tie it down. The present invention can be applied with one person. The present clip system is so efficient that it can actually save the labor of one man in a typical pipe plant.

It should be understood that the foregoing is merely representative of the preferred practice of the present invention and that various changes in the arrangements and details of construction of the present invention may be made without departing from the spirit and scope of the present invention.

I claim:

1. A clip-on stirrup mat for a reinforcement cage for a concrete product, wherein the cage comprises a grid of spaced cage wires, the stirrup mat comprising a grid of spaced mat wires with stirrup elements extending out of the plane of the grid of mat wires, the stirrup mat further comprising:

at least one resilient clip attached to the stirrup mat and extending outwardly therefrom in the direction of application of a mat to a cage, the clip having a relatively narrow outer end that fits between adjacent wires in the cage and having inwardly extending, diverging first and second legs that lead to more widely spaced distal ends that form an inner end of the clip, the first leg being attached to the mat adjacent a distal end of the leg and the second leg being resiliently deflectable toward the first leg, the clip and legs being shaped and positioned on the mat such that as the mat is attached to the cage, the outer end of the clip fits through adjacent wires in the cage and the second leg engages and is deflected toward the first leg by one of the adjacent cage wires when the mat is installed on the cage, the second leg including a gripping surface thereon that engages a wire on the cage as the mat is installed on the cage, the gripping surface resisting the removal of the clip and mat from the wire cage once the mat has been installed.

2. A clip-on stirrup mat according to claim 1 wherein the mat includes a plurality of clips spaced apart over the surface of the stirrup mat.

3. A clip-on stirrup mat according to claim 1 wherein the clip is positioned close enough to an adjacent stirrup element such that the stirrup element and the outer end of the clip can fit between adjacent cage wires when the mat is installed on the cage, with the position and spacing between the second clip leg and the stirrup element being less than the distance between adjacent cage wires at the outer end of the clip and greater than the distance between adjacent cage wires at the inner end of the clip, such that the second leg is deflected toward the first leg as the mat is installed on the cage, the clip thereby resiliently urging said stirrup element toward engagement with the adjacent cage wire.

4. A clip-on stirrup mat according to claim 3 wherein the stirrup mat includes a plurality of generally regularly spaced stirrup elements mounted on generally parallel element wires of the mat and the element wires are interconnected by transverse tie wires, the stirrup mat including a plurality of spaced clips mounted on the element wires between adjacent stirrup elements, with the first legs of the clip being attached to the element wires and the second legs of the clip being unattached to but adjacent to the same element wires, such that the legs are deflected toward each other in the direction of the element wires when the mat is installed on a cage.

5. A clip-on stirrup mat according to claim 1 wherein the mat includes a plurality of stirrup elements mounted on generally parallel element wires, with a plurality of clips being mounted between adjacent stirrup elements at spaced locations on at least certain element wires, the clips extending outwardly from this mat in the same direction as the stirrup elements, the clip legs being oriented for deflection in a direction aligned with the axis of the element wires.

6. A clip-on stirrup mat according to claim 1 wherein the clip is formed of wire in a generally V-shape, with the outer end of the clip comprising a bight portion of the V, the first leg being attached to the mat and the second leg of the clip being unattached to the mat but being resiliently deflectable toward the first leg, the gripping surface of the second leg comprising convolutions at least in the distal end of the second leg.

7. A clip-on stirrup mat according to claim 6 wherein the clip comprises steel wire about 0.142 to 0.225 inches in diameter.

8. A clip-on stirrup mat according to claim 7 wherein the angle between the legs of the clip is about fifteen (15) to thirty (30) degrees, and the legs of the clip are approximately two (2) to three and one-quarter (3¼) inches long.

9. A clip-on stirrup mat according to claim 1 wherein the clip is formed of a wire having the general resilience and elastic and plastic deformation characteristics of eight gage cold-rolled steel wire.

10. A clip-on stirrup mat according to claim 6 wherein the stirrup elements are mounted at approximately two inch intervals on the element wires and the clips are mounted on the element wires between adjacent stirrup elements, the distance between the distal ends of the second legs of the clips and the stirrup elements adjacent the first legs of the clips being sufficiently greater than the distance between adjacent wires in the cage that the clip binds the mat to the cage when the mat is installed on the cage.

11. A clip-on stirrup mat according to claim 2 wherein the shape and spacing of the clips with respect to adjacent stirrup elements on the mat is sufficient to permit attachment of the mat to a double layer cage, even if the wires in the separate layers are not in axial alignment with each other.

* * * * *